US007225971B1

(12) United States Patent
Cherry

(10) Patent No.: US 7,225,971 B1
(45) Date of Patent: Jun. 5, 2007

(54) GROUND MAIL NOTIFICATION SYSTEM

(76) Inventor: John M. Cherry, 276 Gibbs Rd., Mooresville, NC (US) 28117

( * ) Notice: Subject to any disclaimer, the term of this patent is extended or adjusted under 35 U.S.C. 154(b) by 0 days.

(21) Appl. No.: 11/500,781

(22) Filed: Aug. 8, 2006

(51) Int. Cl.
*A47G 29/12* (2006.01)

(52) U.S. Cl. ..... 232/34; 340/569

(58) Field of Classification Search ..... 232/34, 232/36, 17; 340/569
See application file for complete search history.

(56) References Cited

U.S. PATENT DOCUMENTS

| | | | | |
|---|---|---|---|---|
| 3,909,819 | A | 9/1975 | Radford | |
| 4,520,350 | A | 5/1985 | Huang | |
| 4,633,236 | A | 12/1986 | Buhl | |
| 4,794,377 | A | 12/1988 | Benages | |
| 5,023,595 | A | 6/1991 | Bennett | |
| 5,247,282 | A * | 9/1993 | Marshall | 340/569 |
| 5,979,751 | A * | 11/1999 | Maddox | 232/52 |
| 6,114,959 | A * | 9/2000 | Bennett | 340/569 |
| 6,275,154 | B1 * | 8/2001 | Bennett et al. | 340/569 |
| 6,462,659 | B1 * | 10/2002 | Schuette | 340/569 |
| 6,995,671 | B2 * | 2/2006 | Dutta et al. | 340/569 |
| 2002/0024438 | A1 * | 2/2002 | Roberson | 340/569 |
| 2006/0113368 | A1 * | 6/2006 | Dudley | 232/31 |

* cited by examiner

*Primary Examiner*—William L. Miller

(57) ABSTRACT

A mail sensor system that includes a sensor located in a mailbox that is sensitive to weight and which generates a signal when mail is placed in the mailbox. The system further includes a receiver located in a car that generates a signal upon receipt of a signal from the sensor in the mailbox. A companion sensor can be located in a house associated with the mailbox.

6 Claims, 1 Drawing Sheet

GROUND MAIL NOTIFICATION SYSTEM

TECHNICAL FIELD OF THE INVENTION

The present invention relates to the general art of communication systems, and to the particular field of event detectors which transmit signals upon the occurrence of the event.

BACKGROUND OF THE INVENTION

Mail security is of increasing concern to many individuals and businesses. To prevent theft of checks, such as U.S. social security checks, dividend checks, etc., or to prevent loss or disclosure of confidential business information, there is often an urgent need for individuals or businesses to be alerted when mail delivery occurs. A signal system is particularly desirable for those locations where it is difficult or impossible to view the mailbox. However, with a timely, reliable signal, prompt action can be taken to pick up a mail delivery. For those with a long or physically difficult trip to the mailbox, such a system is also particularly desirable.

A wide variety of mail boxes has been designed for use in rural areas. Generally, it has been the province of the owner to determine by visual examination whether a particular delivery of the mail has been made. To assist in this determination, a movable flag is usually provided with the mail box. Upon delivery of the mail, the mailman rotates the flag to its vertical position to indicate that mail has been left in the box. This simple system requires that an owner who is anxious to know about a delivery keep the flag under more or less continual surveillance. This attendance is particularly difficult when the mailbox is located out of direct view from the house or business for which the mail is intended. This problem is exacerbated if the mailman forgets to move the flag.

Yet another, related problem is associated with a person who is driving their automobile and wishes to pick up the mail on their way into their home. This is a usual occurrence when mailboxes are set up on the end of a long driveway which may serve several houses. This may require the person to stop their vehicle, perhaps in traffic, get out of their vehicle and walk to the mailbox. This may be a problem during inclement weather, or if there is ice or snow on the ground or if the person is not able to walk.

Therefore, there is a need for a system which can alert a user to the arrival of mail even if the person is in their car.

SUMMARY OF THE INVENTION

The above-discussed disadvantages of the prior art are overcome by a mail sensor system that includes a sensor located in a mailbox that is sensitive to weight and which generates a signal when mail is placed in the mailbox. The system further includes a receiver located in a car that generates a signal upon receipt of a signal from the sensor in the mailbox. A companion sensor can be located in a house associated with the mailbox.

Using the mail sensor embodying the present invention will permit a person to determine if mail is in his or her mailbox without getting out of their car. If the signal is properly boosted or placed on the airwaves, the signal can be transmitted to the vehicle no matter where the vehicle is located with respect to the mailbox. This will allow the user to be immediately alerted of the arrival of important mail.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1:
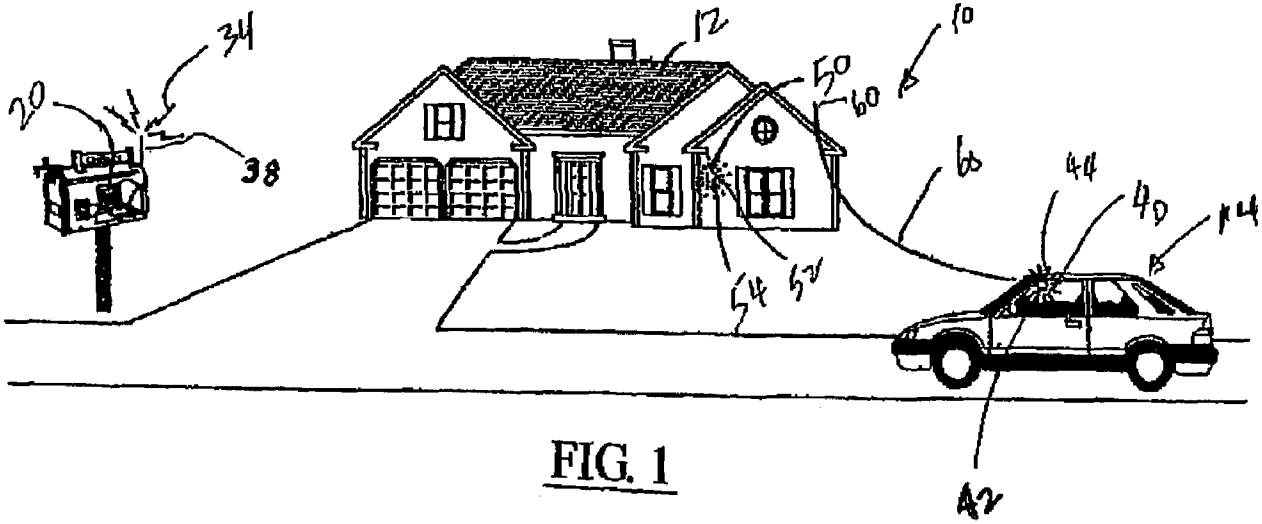
FIG. 1 is a perspective view of a mail alert system for a car and house embodying the present invention.
Figure 3:
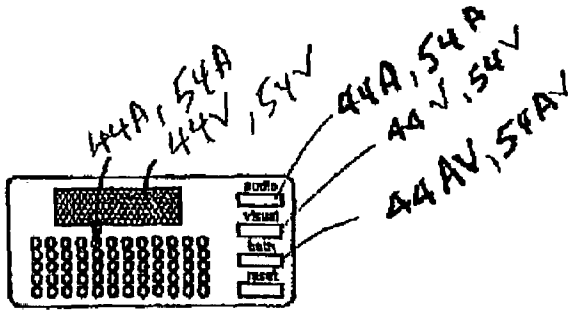
FIG. 3 is a front elevational view of a receiver that receives mail-arrival signals from a mail alert sensor located in a mailbox.
Figure 2:
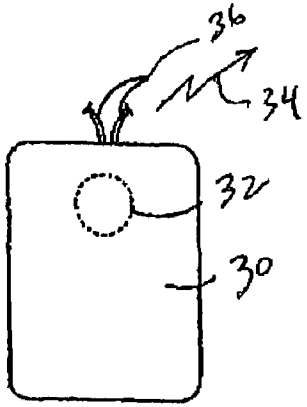
FIG. 2 is a front elevational view of a sensor pad that is located in a mail box to generate a mail-arrival signal when mail is placed in the mailbox.

Referring to the figures, it can be understood that the present invention is embodied in a mail alert system 10 that can alert a user of the delivery of mail whether the user is located in a house or in a car. System 10 comprises house 12, a car 14 and a mailbox 20 which is located spaced apart from the house and spaced apart from the car.

A mail sensor 30 is located in the mailbox. The mail sensor includes a weight-sensitive transducer 32 which is located in the mailbox and which generates a mail-arrival signal 34 via leads 36 connected to an antenna 38 mounted on the mailbox when mail is placed on top of the transducer as when a mail carrier places the mail in the mailbox.

A first receiver 40 is located in the car. The first receiver has circuitry 42 that generates a first signal 44 upon receipt of the mail-arrival signal. First signal 44 can be an audible signal 44A or a visible 44V or a combination 44AV thereof. Using receiver 40, a user need not leave his or her car to determine if mail has arrived, thereby avoiding problems with inclement weather or falling.

A second receiver 50 is located in the house. Second receiver 50 has circuitry 52 that generates a second signal 54 upon receipt of the mail-arrival signal. Second signal 54 can be an audible signal 54A or a visible signal 54V or a combination 54AV thereof.

First and second receivers can be linked in an over-the-air manner whereby the second signal is boosted and re-transmitted by the second receiver to the first receiver as a third signal 60.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A mail alert system comprising:

A) a house;

B) a car;

C) a mailbox located spaced apart from the house and spaced apart from the car;

D) a mail sensor located in the mailbox, the mail sensor including a weight-sensitive transducer located in the mailbox and which generates a mail-arrival signal when mail is placed on top of the transducer;

E) a first receiver located in the car, the first receiver having circuitry that generates a first signal upon receipt of the mail-arrival signal; and F) a second receiver located in the house, the second receiver having circuitry that generates a second signal upon receipt of the mail-arrival signal, where the first and second receivers are linked in an over-the-air manner, the second receiver boosting the second signal to re-transmit as a third signal to the first receiver.

2. The mail alert system defined in claim 1 wherein the first signal includes an audible signal.

3. The mail alert system defined in claim 2 wherein the second signal includes an audible signal.

4. The mail alert system defined in claim 3 wherein the first signal includes a visual signal.

5. The mail alert system defined in claim 4 wherein the second signal includes a visual signal.

6. A mail alert system consisting of:

A) a house;

B) a car;

C) a mailbox located spaced apart from the house and spaced apart from the car;

D) a mail sensor located in the mailbox, the mail sensor including a weight-sensitive transducer located in the mailbox and which generates a mail-arrival signal when mail is placed on top of the transducer;

E) a first receiver located in the car, the first receiver having circuitry that generates a first signal upon receipt of the mail-arrival signal; and F) a second receiver located in the house, the second receiver having circuitry that generates a second signal upon receipt of the mail-arrival signal, where the first and second receivers are linked in an over-the-air manner, the second receiver boosting the second signal to re-transmit as a third signal to the first receiver.

* * * * *